United States Patent [19]

Bloxham

[11] 4,161,941

[45] Jul. 24, 1979

[54] AIR INLET APPARATUS

[75] Inventor: Samuel D. Bloxham, Scarborough, Canada

[73] Assignee: Donald B. Moffatt, Hamilton, Canada

[21] Appl. No.: 845,981

[22] Filed: Oct. 27, 1977

[51] Int. Cl.[2] ..... F24C 3/00

[52] U.S. Cl. ..... 126/85 B; 126/112

[58] Field of Search ..... 126/85 B, 112, 77

[56] References Cited

U.S. PATENT DOCUMENTS

| | | | |
|---|---|---|---|
| 2,561,389 | 7/1951 | Machniak | 126/85 B |
| 3,052,230 | 9/1962 | Conrad | 126/85 B |
| 3,428,040 | 2/1969 | Baker | 126/85 B |
| 3,765,823 | 10/1973 | Kawabam | 126/85 B X |

FOREIGN PATENT DOCUMENTS 685597 5/1964 Canada .

*Primary Examiner*—Nile C. Byers, Jr.

*Attorney, Agent, or Firm*—Rogers, Bereskin & Parr

[57] ABSTRACT

This invention provides a device for use with oil or gas fired furnaces in buildings and more particularly homes to enchance heat efficiency, the device being adapted for installation in an air supply leading from outside the building to the furnace cold air return so that outside air passes through the device, the device including a cylindrical inlet portion, means of defining a chamber attached to the downstream end of the inlet portion and having an internal cross section larger than that of the inlet portion, a frustro-conical section coupled to the chamber means remote from the inlet portion for carrying air from the chamber towards the furnace and converging towards the furnace, a valve assembly to adjust air flow and a baffle plate fixedly positioned at the junction of the chamber means and the frustro-conical section to combine with the valve assembly to inhibit sudden air flow changes caused by pressure fluctuations.

8 Claims, 2 Drawing Figures

AIR INLET APPARATUS

Figure 1:
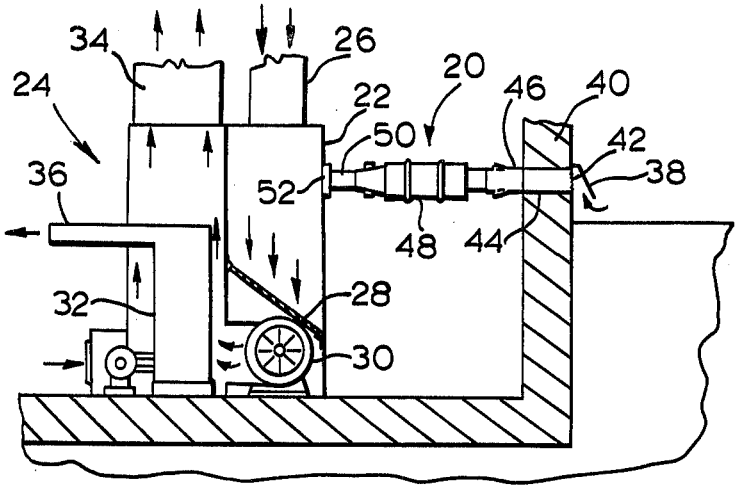

This invention relates to a device for use with a furnace of the oil or gas fired type to enhance the heating effect of such a furnace when installed to heat a building, and more particularly to heat a house.

For purposes of the present description the inventive structure will be described in use in a house. However it is to be appreciated that this is typical of any building structure where an oil or gas fired furnace is used for heating purposes.

Houses lose heat in cold weather in two different ways. Firstly, there is conduction through the walls of the house and this conduction is dependent upon the temperature difference across the walls. Conduction rates will be different at various locations throughout the house and will depend on numerous factors including, installation, sun heating, wind, location of windows, etc.

Secondly, heat is lost when warm air is inspired into the furnace for burning the fuel. This air after burning forms part to the waste gases which issue from the flue. Devices have been used to bring external air directly to the furnace so that only outside air is used to fire the furnace. While such devices have some advantages, one of the main advantages of gas and oil fired heating is lost, namely that the air is no longer changed in the house. Consequently the air will become stale and odorous.

Another way to look at the second heat loss is to consider the heat and moisture which have to be put into the air coming into the house to replace the air passing through the furnace.

The electrical energy used by a furnace is also a consideration. Such energy is used by the fan to circulate warm air about the house and by the burner blower to force air through the combustion chamber. These electrical devices work more efficiently if air is inspired without resistance. In the case of the fan, if no air were lost and if there were adequate return ducts in the system then there would be minimal resistance and the fan would work quite efficiently. However air is being lost through combustion and consequently this air must be made up by the fan and blower combining to draw fresh air through cracks about doors, windows, etc. Electrical energy is used to draw air through these cracks and the problem is emphasised by the householder who attempts to seal up all sources of drafts.

The comfort level in a house is dictated by temperature and humidity. The temperature will be affected by drafts coming into the house the replace air passing through the combustion chamber in the furnace. Obviously if a person sits in a drafty part of the house he will be colder than in a part which is free of drafts.

The present invention controls the flow of air into the house by deliberately feeding colder fresh air into the cold air return near to the furnace combustion chamber. When this colder air is heated it expands and, creates a very slight positive pressure in the house, thereby limiting the possibility of drawing outside air into the house in the form of drafts.

To more fully demonstrate the effect of air control according to the invention, consider initially a house without the device according to the invention. Drafts will enter the house. If a person finds a drafty room to be comfortable at say 70° F., he will achieve this temperature by adjusting the thermostat (which may be remote from the room) so that when the hot air mixes with the cold draft air the result will be 70° F. With controlled air entering the return air directly, there will be little or no draft and no mixing of cold air with the furnace hot air. Consequently for the same comfort level the thermostat would have to be adjusted downwardly thereby reducing the fuel used to heat the house. Also because conduction through the walls and roof is related linearly to the difference between inside and outside temperature, the heat lost will be reduced thereby again saving energy.

Canadian Pat. No. 685,597 which issued on May 5, 1964 to Samuel D. Bloxham et al describes a device which is intended to deliver fresh air to the cold air return. Although the device had some success, it was found that it suffered from some major disadvantages. Firstly, in very windy conditions surging took place which was unacceptable in the furnace, and secondly in some installations it was impossible to adjust the device because access to the device was too limited. By contrast, the present device controls the air flow adequately and adjustment is possible in all installations. The flow control is such that even in very windy conditions fresh air enters the air return without further adjustment of the device.

Accordingly this invention provides a device for use with oil or gas fired furnaces in buildings and more particularly homes to enhance heating efficiency. The device is adapted to be installed in an air supply leading from outside the building to the furnace cold air return so that air from outside the building passes through the device. The device includes:

a cylindrical inlet portion having upstream and downstream ends;

means of defining a chamber attached to the downstream end of the inlet portion and having an internal cross-section larger than that of the inlet portion;

a frustro-conical section coupled to the chamber means remote from the inlet portion for carrying air from the chamber towards the furnace and converging towards the furnace;

a valve assembly comprising means defining a valve seat at the junction of the inlet portion and the chamber means, a conical element contained in the chamber and defining a conical surface engageable with the valve seat to restrict air flow, and carrier means coupled to the chamber means and to the conical element to locate the element relative to the valve seat and to permit adjustment of the element towards and away from the valve seat to thereby adjust air flow; and a baffle plate fixedly positioned at the junction of the chamber means and the frustro-conical section to combine with the valve assembly to inhibit sudden air flow changes caused by pressure fluctuations.

Figure 2:
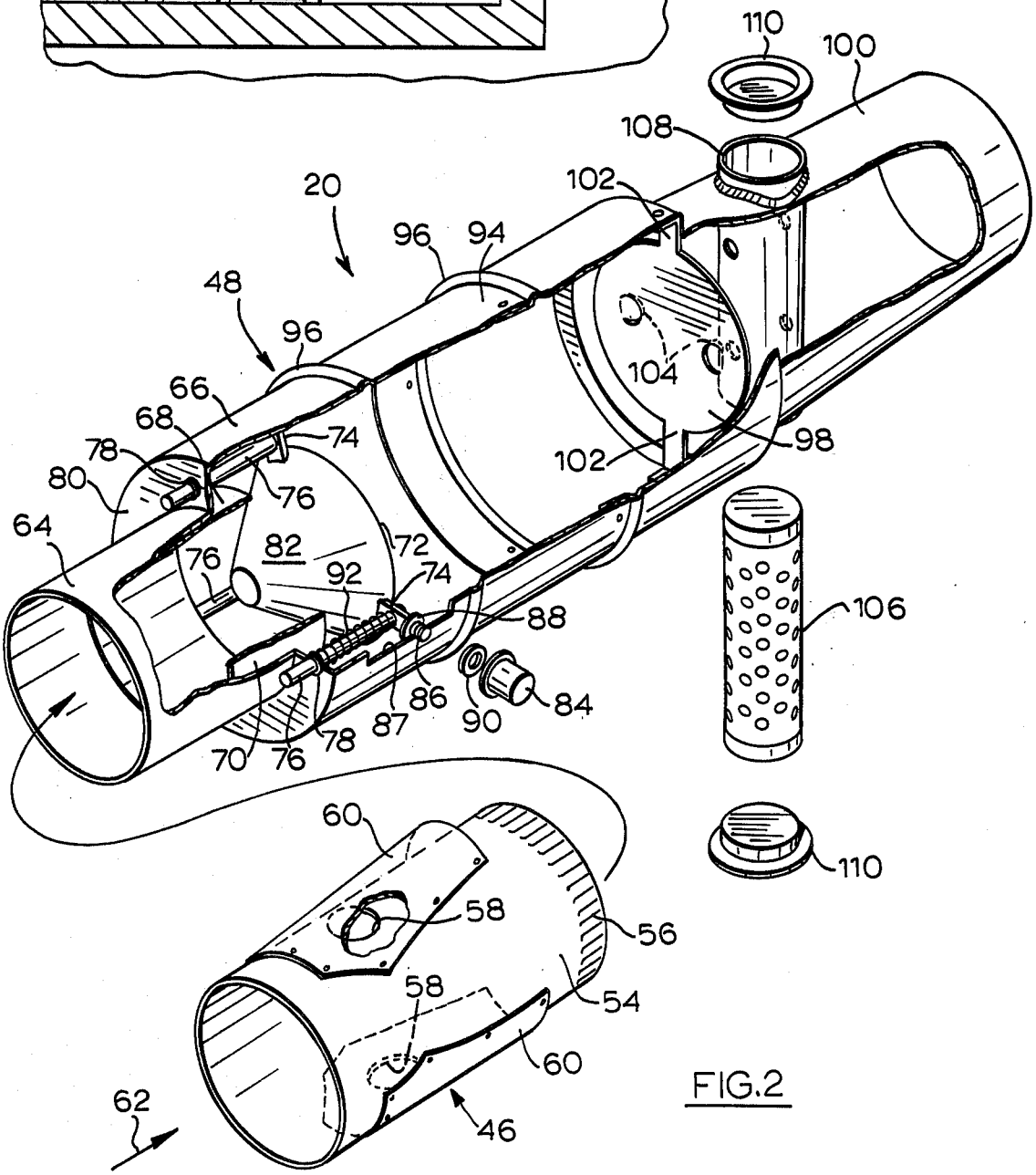

The invention will be better understood with reference to the drawings in which:

FIG. 1 is a somewhat diagrammatic side view of an oil or gas furnace in position in a house and attached to a device according to the invention; and FIG. 2 is an exploded perspective view with parts broken away to illustrate the structure of the device.

Reference is made first to FIG. 1 which illustrates the general location of an air inlet device 20 according to the invention positioned to permit external air to be drawn from the exterior of the house into an air inlet return 22 of an oil or gas furnace 24. As is conventional in such a furnace, cold air is returned from a duct 26 and drawn through a filter 28 by a fan 30 which then blows the filtered air over the outer wall of a combustion chamber 32 to heat the air before it leaves by way of a main heating duct 34. Exhaust gases from the combustion chamber 32 leave by way of a pipe 36 which is connected to a flue (not shown).

As will be described, the amount of air permitted to flow through the device 20 can be controlled to create a slight super-atmospheric pressure within the house. This ensures that any air entering the house to replace the lost air going through the combustion chamber 32 and pipe 36 is replaced by air coming through the device 20. The slight super-atmospheric pressure is created by expanding the return air and the fresh air from outside before the hot air leaves by way of a heating duct 34. It is important to understand that the air entering the device 20 substantially replaces air which was formerly drawn through parts of the house such as doors and windows to replace the air which was leaving by way of the flue. The resulting slight super-atmospheric pressure eliminates drafts where they were formerly created as the air entered the house through the doors etc. and a more even and controlled heating results. Formerly the house would have hot areas and cold areas and of course the thermostat would be set to control the cold areas. A controlled air system limits drafts thereby eliminating the cold areas to give a more even heat and a more pleasant environment in the house at a lower thermostat setting than was used previously. Heat conduction through the walls is thereby reduced resulting in a fuel saving.

As also seen in FIG. 1, external air is drawn through a weather shield 38 on the outside surface of a wall 40, through a protective gauze 42 and into a pipe section 44. The device 20 includes a condensation limiter 46 which is attached directly to the pipe 44 and through which air passes on its way to a main portion 48 of the device. The length of pipe between the limiter 46 and the main portion 48 will depend upon the distance between the furnace 24 and the wall 40 and in some instances the arrangement will be such that the main portion 48 rests against the side of the furnace. In the arrangement shown the main portion 48 is attached by a short pipe 50 to an attachment 52 on the side of the furnace. However if the space between the furnace and the wall 40 is limited, the pipe 50 can be replaced by an elbow and the device will then lie adjacent to the side of the furnace and and lead to a different wall or another part of the wall.

The structure of the device will be better understood with reference to the following description related to FIG. 2. In this figure the main portion 48 previously mentioned is shown exploded from the condensation limiter 46 which was also mentioned with reference to FIG. 1. The device will be described from one end and in the direction air travels on its way from outside the house to the furnace 24. (FIG. 1).

The condensation limiter 46 consists essentially of a cylindrical pipe section 54 carrying a conventional crimped end 56 for engagement either directly in the main portion 48 or in extension pipes. The section 54 defines a pair of diametrically opposed openings 58 which are covered by respective ones of a pair of air guides 60. These guides fit closely about the section 54 except at their ends where they define axial inlets for drawing air towards openings 58. As air is inspired through the section 54 in the direction indicated by arrow 62, secondary air from within the building is drawn over the surface of the section 54 and into the air guides 60 before passing through openings 58 into the main flow of air. This warmer secondary air from within the house flows over the section 54 and associated piping adjacent this section to reduce the possibility of external condensation caused by the cold fresh air chilling the pipe on its way to the furnace. This simple structure has proved most efficient in preventing condensation in very cold climates where removal of moisture from inside air is very undesirable.

Once the fresh air meets the main portion 48 it enters by way of an inlet portion 64 on its way to a cylindrical chamber 66. This chamber is of larger diameter than the inlet portion 64 and entry into the chamber is controlled by a valve assembly 68. A sleeve 70 is fitted inside the inlet portion 64 and projects into the chamber 66 to define a seat for a generally conical element 72 having a rounded leading end. The element defines three lugs 74 (two of which are shown) permanently attached both to the element and one to each of three equally spaced guide rods 76 which ride in respective bushings 78 (two of which are seen) set in an end wall 80 of the chamber 66. The arrangement is such that the axis of the cone defining a front surface 82 of the element 72 is common with the axis of the inlet portion 64, sleeve 70, and chamber 66.

The valve assembly is adjusted by a control knob 84 which is threadably engaged on a stud 86 projecting through a slot 87 the wall of chamber 66 from the nearest of the lugs 74 as drawn. An inside washer 88 is provided on the stud for riding on the inner surface of the chamber 66 and a further or outer washer 90 rides on the outer surface of the chamber. The knob can be engaged tightly onto the stud 86 to lock the element 72 axially relative to the valve seat on the end of sleeve 70.

The lug 74 associated with the control knob 84 also forms an end stop for a coiled compression spring 92 which bears at its other end against an associated one of the bushings 78. This spring avoids locking or binding when adjusting the valve as will now be described.

In some installations it is essential that control of the valve be provided from one side of the device only. This is because the device could be located against the side of the furnace or against a wall surface due to fact that there is often limited space around a house furnace where the device is to be fitted. In moving the valve element 72, it will be appreciated that when a force is applied to the knob 84 there will be a tendency for the element to rotate transversely thereby creating binding of the guide rod 76 in the bushings 78.

It has been found that the use of the compression spring 92 is beneficial. As soon as there is a tendency to bind, the user will relax the force used to move the knob and the spring will move the knob and element 72 back slightly thereby unlocking whatever caused the binding. This action takes place almost continuously and smoothly so that the user is hardly aware of binding action.

The main portion 48 includes two body halves which meet at a riveted joint 94. The halves are formed from sheet material and ribs 96 are provided for added strength.

After air has entered the chamber 66, it passes around a baffle plate 98 located at the downstream end of the chamber 66. The plate is generally circular and is located where the chamber 66 meets a frustro-conical section 100. The section 100 converges away from the chamber 66 and at its end adjacent the chamber it has a diameter slightly larger than that of the central portion of battle plate 98. This plate includes a pair of extensions 102 used to rivet the plate in place as shown.

The main purpose of the baffle plate 98 is to enhance the buffer effect of the chamber 66. Because the device is to be connected to external air, it will be subject to wind forces which can create both pressure and vacuum as the wind fluctuates. The volume of air contained in the chamber 66 tends to act as a buffer and control of this volume is achieved partly by the fixed baffle plate 98 and partly by the adjustable valve assembly 88. In any particular installation the valve assembly 68 must be adjusted after installation to achieve the desired effect. Once fixed however, it is rarely necessary to adjust the valve assembly.

It has been found somewhat difficult to provide a baffle 98 to give the desired results. Unexpectedly it was found that if a pair of pressure relief flaps 104 were raised out of the structure of the main portion of the baffle plate, then a smoother action resulted. It is believed that the minimal flow through the openings adjacent the flaps prevents local pressure drops and turbulence around the plate.

The frustro-conical section 100 tends to streamline air flow after it is passed the baffle plate 98. An air-freshener capsule 106 can be inserted in the section 100 using a transverse cylindrical container 108 having containing end caps 110 to hold the capsule in position and to provide access for replacing the capsule. The cylindrical container 108 is perforated so that some of the air passing through the section 100 will also pass through the capsule 106.

It will be appreciated that the condensation limiter 46 is optional. This device is not a significant part of the structure from the standpoint of enhancing the furnace heating effect but is nevertheless desirable if condensation problems are to be avoided. In some situations it may be that warm air is passing over the part of the furnace room where the device is being used and consequently the limiter may not be necessary. Similarly, it is not essential to use the capsule 106 and in situations where this is not desired the cylinder 108 and associated parts would be omitted from the device.

Care should be taken during installation to ensure that the air is delivered to a portion of the air return in the furnace where adequate mixing will take place. The device should be located such that the control knob 84 can be moved for adjusting the valve assembly 68 and also to service this assembly. However, as indicated there is little likelihood that the valve will be adjusted more than once for a given furnace in a particular location. Consequently after initial use the adjustment and service will be minimal.

It is preferable to locate the inlet weather shield 38 (FIG. 1) at a convenient location where there is little likelihood of moisture entering the weather shield. A convenient position would be behind a bush or other obstacle which would tend to limit wind velocities impinging on the weather shield 38.

What I claim as my invention is:

1. A device for use with oil or gas fired furnaces in buildings and more particularly homes to enhance heating efficiency, the device being adapted to be installed in an air supply leading from outside the building to the furnace cold air return so that air from outside the building passes through the device, the device comprising:

a cylindrical inlet portion having upstream and downstream ends;

means defining a chamber attached to the downstream end of the inlet portion and having an internal cross-section larger than that of the inlet portion;

a frustro-conical section coupled to the chamber means remote from the inlet portion for carrying air from the chamber towards the furnace and converging towards the furnace;

a valve assembly comprising means defining a valve seat at the junction of the inlet portion and the chamber means, a conical element contained in the chamber and defining a conical surface engageable with the valve seat to restrict air flow, and carrier means coupled to the chamber means and to the conical element to locate the element relative to the valve seat and to permit adjustment of the element towards and away from the valve seat to thereby adjust air flow; and a baffle plate fixedly positioned at the junction of the chamber means and the frustro-conical section to combine with the valve assembly to inhibit sudden air flow changes caused by pressure fluctuations.

2. A device as claimed in claim 1 in which the valve carrier means comprises:

three parallel guide rods fixedly coupled to the conical element and spaced equally about this element and normal to a plane containing the said valve seat, each of the rods being slidably coupled to the chamber means for movement towards and away from said valve seat; and means coupled to the conical element and providing an external control whereby said movement can be effected.

3. A device as claim in claim 1 in which the baffle plate has a pair of flaps raised from the material of the plate to provide some air flow through the plate.

4. A device as claimed in claim 1 in which the device further includes means coupled to the frustro-conical portion for containing an air freshner in the air flow.

5. A device as claimed in claim 2 in which the baffle plate has a pair of flaps raised from the material of the plate to provide some air flow through the plate.

6. A device as claimed in claim 1 and further comprising a condensation limiter for positioning immediately inside a wall of the building to receive the colder air entering the building on its way to the device and adapted to be coupled to the inlet portion for guiding the air to the inlet portion, the condensation limiter comprising a generally cylindrical pipe section defining at least one opening, and an air guide attached to the pipe section, the air guide being attached over the opening to define an air inlet at a location spaced from the opening towards said inlet portion whereby when air passes through the condensation limiter, secondary air is inspired through the opening thereby drawing air through the inlet so that the secondary air passes generally over the device to limit condensation caused by the colder air from outside the building passing through the device.

7. A device as claimed in claim 6 in which there are two such openings spaced diametrically about the pipe section and in which there are two such air guides positioned one about each of the openings to provide two said inlets.

8. In an oil or gas fired furnace system used in a building such as at home, and including a furnace, hot air ducts leading hot air from the furnace to parts of the building, a cold air return from said parts of the building back to the furnace and a furnace burner and flue system, the improvement in which a device is provided to permit the furnace to inspire colder air from outside the building into the cold air return for heating by the furnace, said device comprising:

a cylindrical inlet portion operatively coupled to the outside of the building for receiving said colder air from outside the building and having an upstream end towards the outside of the building and a downstream end;

means defining a chamber attached to the downstream end of the inlet portion and having an internal cross-section larger than that of the inlet portion;

a frustro-conical section coupled to the chamber remote from the inlet portion for carrying air from the chamber towards the furnace and converging towards the furnace;

a valve assembly comprising means defining a valve seat at the junction of the inlet portion on the chamber means, a conical element contained in the chamber and defining a conical surface engageable with the valve seat to restrict air flow, and carrier means coupled to the chamber and to the conical element to locate the element relative to the valve seat and to permit adjustment of the element towards and away from the valve seat to thereby adjust air flow;

a baffle plate fixedly positioned at the junction of the chamber and the frustro-conical section to inhibit sudden flow changes caused by pressure fluctuations; and means coupling the frustro-conical section to the furance cold air return to complete the colder air path to the furnace.

* * * * *